United States Patent [19]

Omata

[11] Patent Number: 4,828,344

[45] **Date of Patent: * May 9, 1989**

[54] DRAWER DEVICE

[75] Inventor: Nobuaki Omata, Tokyo, Japan

[73] Assignee: Nifco Inc., Yokohama, Japan

[ * ] Notice: The portion of the term of this patent subsequent to Mar. 18, 2003 has been disclaimed.

[21] Appl. No.: 776,501

[22] Filed: Sep. 16, 1985

[30] Foreign Application Priority Data

Sep. 26, 1984 [JP] Japan ..... 59-199455

[51] Int. Cl.[4] ..... A47B 88/00

[52] U.S. Cl. ..... 312/319; 312/330 R; 312/341 NR

[58] Field of Search ..... 312/319, 341 NR, 330 R, 312/341 R; 188/290, 322.5; 185/39

[56] References Cited

U.S. PATENT DOCUMENTS

| | | | |
|---|---|---|---|
| 398,626 | 2/1889 | Koch et al. | 312/319 |
| 588,565 | 8/1897 | Friesen | 312/319 |
| 1,699,710 | 1/1929 | Pearlman | 312/319 X |
| 2,963,940 | 12/1960 | Raabe | 312/319 X |
| 3,651,903 | 3/1972 | Butler et al. | 188/290 |
| 3,757,909 | 9/1973 | McClure | 188/290 |
| 4,494,806 | 1/1985 | Williams et al. | 312/330 R X |
| 4,550,470 | 11/1985 | Omata | 188/290 X |
| 4,565,266 | 1/1986 | Omata | 188/290 X |
| 4,576,252 | 3/1986 | Omata | 188/290 X |
| 4,586,761 | 5/1986 | Shimbara | 312/219 |
| 4,602,828 | 7/1986 | Omata | 312/15 X |
| 4,660,881 | 4/1987 | Komeya et al. | 185/39 X |

FOREIGN PATENT DOCUMENTS

| | | | |
|---|---|---|---|
| 92404 | 6/1984 | Japan . | |
| 193503 | 11/1984 | Japan . | |
| 222631 | 12/1984 | Japan | 188/290 |

*Primary Examiner*—Kenneth J. Dorner
*Assistant Examiner*—Thomas A. Rendos
*Attorney, Agent, or Firm*—Richard Bushnell

[57] ABSTRACT

A drawer device comprises a drawer and a frame. Either the drawer or the frame is provided with a rack extending in the direction of movement of the drawer, and the other is provided with a rotary damper, which inlcudes a spiral spring adapted to be wound from one end thereof as the drawer is pushed into an accommodation space in the frame, a locking member for locking the spiral spring against unwinding when the drawer is pushed into the accommodation space and a gear capable of being rotated in the forward and reverse directions under a braking force with the movement of the drawer. The gear and rack are coupled together. A bearing is provided between cooperating, relatively slidable surfaces of the drawer and frame.

2 Claims, 3 Drawing Sheets

DRAWER DEVICE

FIELD OF THE INVENTION AND RELATED ART STATEMENT

This invention relates to a drawer device, in which a drawer can be projected from and accommodated into a frame.

Japanese Utility Model Application Public Disclosure SHO No. 59(1984)-92404 discloses a drawer device, in which a drawer-like member constituting a keyboard musical instrument can be projected from and accommodated into a frame of a tape recorder. In this device, a pair of stationary rails are provided along opposite sides of a drawer accommodation space of the frame, and the drawer is slidably supported on the stationary rails via slide rails such that it can be moved for a predetermined stroke.

In this prior art drawer device, a constant speed pusher including a flywheel, tension spring, etc. is used for projecting the accommodated drawer to the outside of the frame. The device, therefore, requires as essential elements locking means for locking the drawer in the accommodation space in the device against the force of the constant speed pusher and means for releasing the lock of the locking means. Therefore, the assembly of the device requires a large number of operations. In addition, a large space is necessary for accommodating the means noted above, so that the overall size of the device is inevitably large.

Further since the stationary rails and slide rails are in direct contact with one another and also the slide rails and drawer are in direct contact with one another, much friction is generated, and the frictional surfaces are worn out with use, which results in rattling.

OBJECT AND SUMMARY OF THE INVENTION

An object of the invention is to provide a drawer device, which is small in size and can withstand use for a long time.

According to the invention, either the drawer or the frame is provided with a rack extending in the direction of movement of the drawer while the other is provided with a rotary damper which includes a spiral spring adapted to be wound from one end thereof as the drawer is pushed into an accommodation space in the frame, a locking member for locking the spiral spring against unwinding when the drawer is pushed into the accommodation space and a gear capable of being rotated in the forward and reverse directions under a braking force with the movement of the drawer, the gear and rack being coupled together, a bearing being provided between cooperating, relatively slidable surfaces of the drawer and frame.

When the drawer is pushed into the accommodation space of the frame, the spiral spring of the rotary damper is wound from one end due to the mesh between the rack and gear. When the drawer is perfectly accommodated in the accommodation space, the spring is substantially completely wound up and is locked in this state by a locking member. The drawer thus can be held accommodated in the accommodation space.

When the accommodated drawer is pushed slightly inwardly, the spring is released from the locking member. As a result, the gear is rotated by the restoring force of the spring being unwound to force the drawer out from the frame. At this time the gear is braked against rotation by the viscosity of a braking fluid, so that the drawer is projected slowly.

Since the bearing is provided between the cooperating, relatively slidable surfaces of the drawer and frame, light and smooth movement of the drawer can be ensured.

The above and other objects and features of the invention will become more apparent from the description having reference to the accompanying drawings.

DETAILED DESCRIPTION OF THE PREFERRED EMBODIMENT

Figure 1:
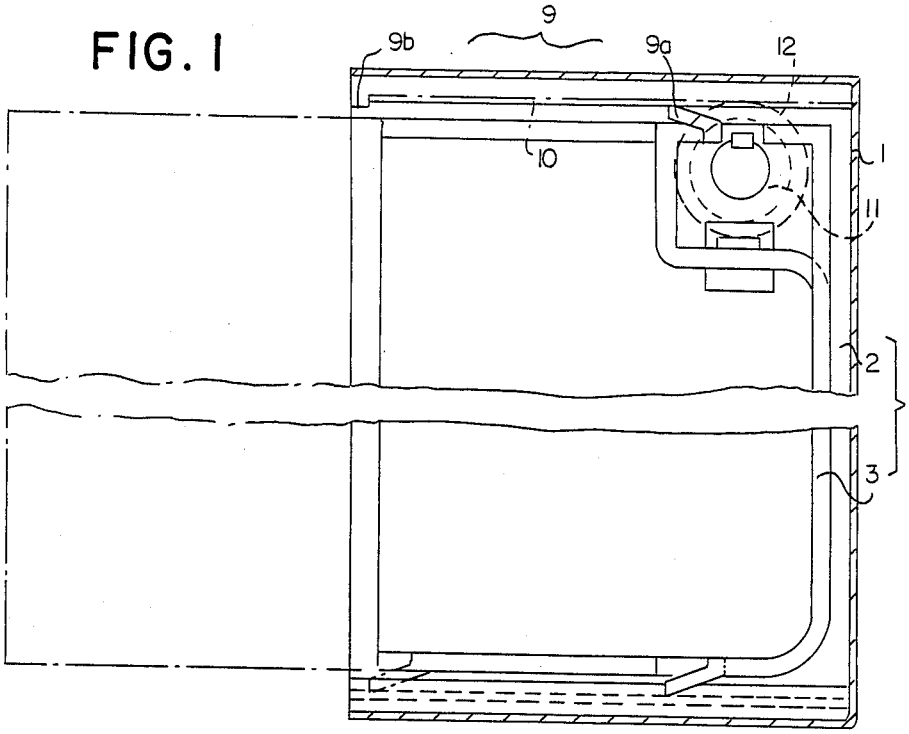
FIG. 1 is a plan view, partly broken away, showing an embodiment of the drawer device according to the invention.
Figure 2:
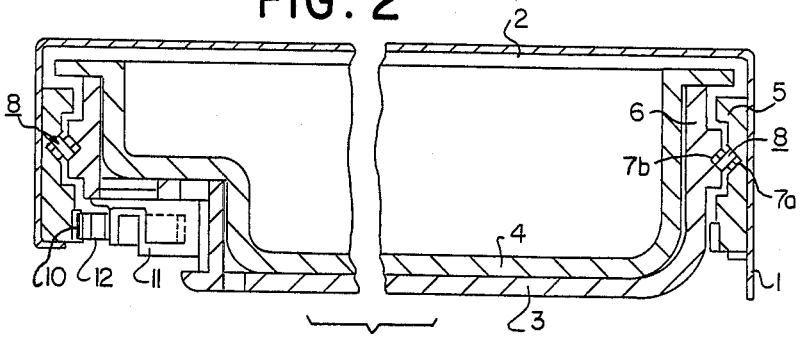
FIG. 2 is a transverse sectional view showing the drawer device shown in FIG. 1.
Figure 3:
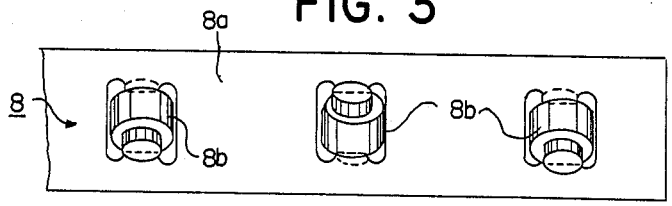
FIG. 3 is an enlarged front view showing a cross roller bearing intervening between a drawer and a frame.

Referring now to the drawings, there is shown an embodiment of the invention. Reference numeral 1 designates a frame with an accommodation space 2, and numeral 3 a drawer. In this embodiment, the drawer 3 is an ashtray support supporting an ashtray 4. Also in this embodiment, the frame 1 is open at the front and at the bottom. The drawer 3 can be projected from the front side of the frame 1 and pushed back into the accommodation space 2 from this side.

The cooperative side walls 5 and 6 of the frame and drawer are formed with respective grooves *7a* and *7b* which extend in the direction of movement of the drawer and have a triangular sectional profile. Cross roller bearings 8 are provided in each pair of grooves *7a* and *7b* to permit smooth movement of the drawer and prevent detachment of the drawer from the open bottom of the frame The bearings may of course be provided for the sole purpose of permitting smooth movement of the drawer, and separate retaining means may be provided for retaining the drawer with respect to the frame. If necessary, a stopper mechanism may be provided to prevent the drawer from being withdrawn after a substantial portion thereof has been projected. In this embodiment, such a stopper mechanism 9 consists of a pawl *9a* provided on the drawer near the inner end thereof and a protuberance *9b*, which is provided t the front end of the frame, and against which the pawl *9a* strikes. In this embodiment, a rack 10 is provided on a side wall 1 of the frame 5 separately of the grooves *7a*. The rack 10 extends in the direction of movement of the drawer. The drawer is provided with a rotary damper 11 with a stopper. The rotary damper 11 has a gear 12 in mesh with the rack 10.

The rotary damper 11 with stopper may be of any structure so long as it is capable of braking the gear 12 against rotation in both the forward and reverse directions by the viscosity of silicone oil or the like and, at the time of rotation in either the forward or reverse direction, stores a restoring force in a spring, e.g., a spiral spring, the gear being prevented by a stopper utilizing a heart cam or the like against rotation in an opposite direction toward the end of rotation in one direction, the gear having been prevented by the stopper against rotation in the opposite direction being slightly rotated in one direction until a lock mechanism is released, whereupon the gear is caused to rotate in the opposite direction by the restoring force of the spring under a braking force.

Figure 4:
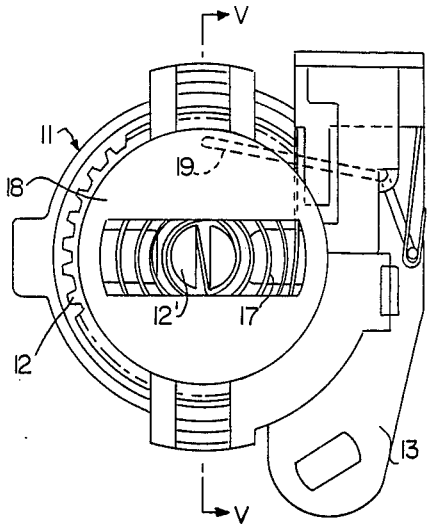
FIG. 4 is a plan view showing a rotary damper used in the drawer device according to the invention.
Figure 5:
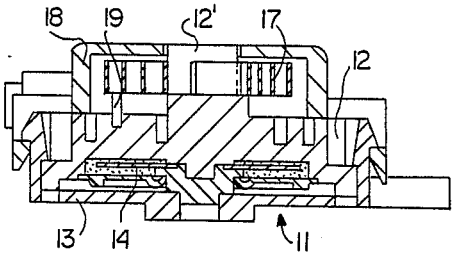
FIG. 5 is a sectional view taken along line V—V in FIG. 4.
Figure 6:
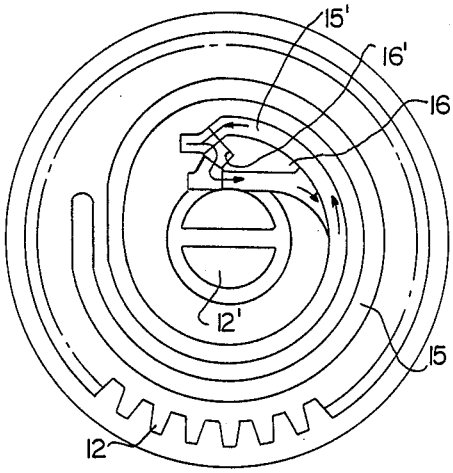
FIG. 6 is a plan view showing a spiral groove formed in a gear of the rotary damper shown in FIG. 4.
Figure 7:
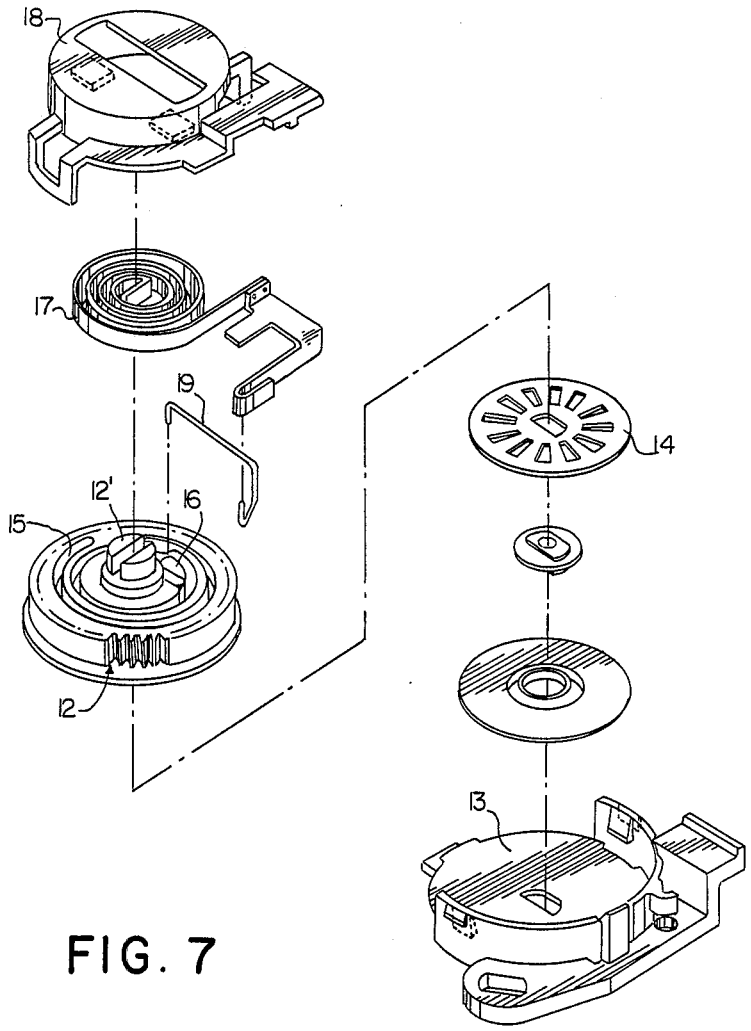
FIG. 7 is an exploded perspective view showing a rotary damper shown in FIG. 4.

FIGS. 4 to 7 show a damper disclosed in Japanese Patent Application Public Disclosure SHO No. 59(1984)-193503 (U.S. patent application Ser. No. 598,534), and its operation will now be briefly described.

The gear 12 is rotatably mounted on a mounting base 13. A brake disk 14 secured to the base is fitted in a bottom recess of the gear. Silicone grease is provided between the bottom surface of the gear and the facing surface of the brake disk to brake the gear against rotation in the forward and reverse directions. The top surface of the gear is formed with a spiral groove 15 with an inner end unidirectional path 15' surrounding an island 16. The top of the gear also has a boss 12', to which the inner end of a spiral spring 17 is secured. A cover 18 which is assembled separately of the base 13 covers the top of the gear. A portion of the edge of the gear projects through the cover and meshes with the rack 10 provided on the drawer 3 noted above. An elastic stop pin 19 is provided in the cover 1. The stop pin 19 has a downwardly bent end portion extending into the spiral groove 15. The spiral spring 17 has an outer end secured to the cover 18, and it is accommodated in the cover above the stop pin 19.

The damper 11 has its base 13 secured to the underside of the drawer so that it is directed downwards.

When the drawer is accommodated in the accommodation space, the spiral spring 17 is in a contracted state with the restoring force stored in it. In this state, the end of the stop pin 19 is hooked on a notched portion 16' of the island, so that the gear 12 is locked against rotation by the restoring force of the spring.

When the drawer 3 is slightly pushed inwardly from this state from the open front of the frame with a finger, the stop pin 19 is detached from the notch of the island. As a result, the gear 12 is rotated slowly by the restoring force of the spring while being damped by a braking force provided by the silicone grease, causing the drawer to be projected from the accommodation space along the rack 10 coupled to it. The spiral spring may be designed such that its restoring force is exhausted when a major portion of the drawer is projected. Alternatively, the drawer may be stopped by the stopper as noted before.

When the drawer 3 in the projected state is pushed into the accommodation space 2, the gear 12 is rotated in the reverse direction to wind the spiral spring 17 from the inner end thereof, and the stop pin 19 is moved back along the spiral groove 15. Toward the end of this stroke when the drawer has been substantially accommodated in the accommodation space, the stop pin 19 is moved along the unidirectional path 15' around the island 16. When the pushing force is removed at the end of a slight overshoot of the drawer into the accommodation space, the gear 12 is rotated in the reverse direction by the restoring force stored in the spring 17 to move the drawer lightly in the outward direction until the end of the stop pin 19 is hooked in the notch 16' of the island 16. Thus, the drawer is no longer moved outwardly but is held accommodated in the accommodation space. To project the drawer, the drawer is again pushed slightly inwardly to detach the stop pin 19 from the notch 16' of the island.

In the above embodiment the rotary damper 11 is provided on the drawer with its gear 12 in mesh with the rack 10 provided on the frame. However, it is also possible to provide the rotary damper 11 on the frame with the gear 12 in mesh with a rack provided on the drawer for obtaining the same effects.

Further, in the above embodiment the cross roller bearing 8 is used, in which rollers **8*b* are arranged in a row in a strip 8*a*** of celluloid or the like such that adjacent ones of them are in mutually perpendicular orientations. However, it is possible to use a bearing of a different type.

As has been made apparent in the foregoing, according to the invention it is possible to provide a drawer device, which may be very small in size, has a reduced number of components, can ensure smooth operation for a long time, and is suited particularly for an automotive drawer type ashtray, a compact disk player to be projected for use from the body of an electronic musical acoustic apparatus, or a drawer of a keyboard musical instrument.

What is claimed is:

1. A drawer device comprising a drawer and a frame having an accomodation space, in which said drawer is slidably accomodated, either said drawer or said frame being provided with a rack extending in the direction of movement of said drawer, the other being provided with a rotary damper including a spiral spring being wound from one end thereof as said drawer is pushed into said accommodation space, said rotary damper including a cylindrical space of short axial length relative to its diameter, a disc in said space perpendicular to the axis of said space and having a plurality of arcuately spaced perforations therein, and a fluid of predetermined viscosity in said space, a locking member for locking said spiral spring against unwinding when said drawer is pushed into said accommodation space and a gear capable of being rotated in the forward and reverse directions under a braking force with the movement of said drawer, said gear and said rack being coupled together, and a bearing being provided between cooperating, relatively slidable surfaces of said drawer and frame.

2. A drawer device according to claim 1 wherein said gear includes an axially opening spiral groove therein having a detent at one end thereof, and wherein said locking member comprises an elongated resilient linear member having one end fixed relative to one of said drawer and said frame, and the other end being received in said spiral groove.

* * * * *

UNITED STATES PATENT AND TRADEMARK OFFICE

CERTIFICATE OF CORRECTION

PATENT NO. : 4,828,344

DATED : May 9, 1989

INVENTOR(S) : Nobuaki Omata

It is certified that error appears in the above-identified patent and that said Letters Patent is hereby corrected as shown below:

Column 3, Line 30 "cover 1" to --cover 18--

Column 4, Line 50 "force with" to
-- force produced by said fluid with ---

Signed and Sealed this

Thirty-first Day of July, 1990

*Attest:*

*Attesting Officer*

HARRY F. MANBECK, JR.

*Commissioner of Patents and Trademarks*